United States Patent [19]

Minegishi et al.

[11] Patent Number: 4,458,637

[45] Date of Patent: Jul. 10, 1984

[54] GLOW PLUG FOR USE IN DIESEL ENGINE AND METHOD OF MANUFACTURING THE SAME

[75] Inventors: Sokichi Minegishi; Tozo Takizawa, both of Higashimatsuyama; Morimasa Furusawa, Kumagaya, all of Japan

[73] Assignee: Jidosha Kiki Co., Ltd., Tokyo, Japan

[21] Appl. No.: 483,425

[22] Filed: Apr. 8, 1983

Related U.S. Application Data

[62] Division of Ser. No. 350,211, Feb. 19, 1982.

[30] Foreign Application Priority Data

Mar. 27, 1981 [JP] Japan ..... 56-42240

[51] Int. Cl.[3] ..... F02P 19/02

[52] U.S. Cl. ..... 123/145 A; 219/267; 219/270; 361/266

[58] Field of Search ..... 219/260, 267, 270, 541, 219/552; 29/520, 611, 616, 617, 621; 123/145 R, 145 A 272; 431/262; 361/264, 265, 266

[56] References Cited

U.S. PATENT DOCUMENTS

| | | | |
|---|---|---|---|
| 2,024,387 | 12/1935 | Rabezzana | 123/145 A |
| 2,030,937 | 2/1936 | Reichmann | 219/270 X |
| 2,130,365 | 9/1938 | Paulson | 123/145 A |
| 3,017,541 | 1/1962 | Lawser | 123/145 A X |
| 3,319,130 | 5/1967 | Batteridge | 123/145 A |
| 3,749,980 | 7/1973 | Balter | 219/267 |
| 4,029,936 | 6/1977 | Schweitzer | 219/267 |
| 4,107,510 | 8/1978 | Tombs et al. | 219/270 |
| 4,252,091 | 2/1981 | Steinke | 123/145 A |
| 4,292,934 | 10/1981 | Knowles | 123/145 A |
| 4,357,526 | 11/1982 | Yamamoto et al. | 219/544 |

FOREIGN PATENT DOCUMENTS

| | | |
|---|---|---|
| 109536 | 8/1979 | Japan . |
| 126989 | 10/1980 | Japan . |

*Primary Examiner*—Volodymyr Y. Mayewsky
*Attorney, Agent, or Firm*—Charles E. Pfund

[57] ABSTRACT

In a glow plug for use in a diesel engine of the type wherein a heater rod is connected to one end of a hollow holder, and an external connecting terminal is inserted into the other end of the hollow holder through an electric insulator and electrically connected to the heater rod, an integrally combined terminal unit including a metal pipe, an electric insulator and the external connecting terminal embedded in the insulator is prepared. After inserting the terminal unit into the other end of the hollow holder, an external pressure is applied to the other end to deform the metal pipe for firmly bonding the metal pipe to the insulator. Thereafter an end surface of the other end of the hollow holder is caulked to form an annular ring that holds the inserted terminal unit. With this construction, the completed glow plug is maintained in a perfect air tight state regardless of the variation in the ambient temperature.

4 Claims, 4 Drawing Figures

GLOW PLUG FOR USE IN DIESEL ENGINE AND METHOD OF MANUFACTURING THE SAME

This is a division, of application Ser. No. 350,211 filed Feb. 19, 1982.

BACKGROUND OF THE INVENTION

This invention relates to a glow plug adapted to preheat the inside of a cylinder of a diesel engine and a method of manufacturing the glow plug.

At low temperatures, since a diesel engine is difficult to start, a glow plug is disposed in a cylinder of the engine and electric current is passed through the glow plug to raise the temperature inside of the cylinder, thus facilitating the starting at low temperatures. Among the glow plugs may be mentioned a sheath heater constituted by a heat resistant metal sheath containing a helical electric heating wire embedded in a powder of heat resistant insulating material, and a heating rod comprising a resistor embedded in a ceramic material.

In a prior art glow plug of the type described above, a heater rod is supported at the fore end of a hollow metal holder and an external connecting terminal is secured to the rear end of the holder. The external connecting terminal and the rear end of the heater rod are interconnected by an electric conductor. With this prior art construction, for the purpose of insulating the external connecting terminal from the holder, an insulating bushing made of resin is inserted through the rear opening of the holder to surround the fore end of the terminal, and the periphery of the rear opening is squeezed to secure the insulating bushing to the holder.

With this construction, the external connecting on terminal is held by the periphery of the holder opening squeezed about the periphery of the insulating bushing to prevent from disengaging in the axial direction. Furthermore, owing to the difference in the thermal expansion coefficients of the insulating bushing and the holder, the bonding therebetween would be loosened.

The insulating bushing is generally made of a thermosetting artificial resin so that when used over a long period, due to a large difference in the ambient temperature, the molded insulating bushing slightly shrinks. This can be readily understood from the fact that the ambient temperature varies greatly during the running and standstill of the diesel engine utilizing the glow plug.

The metal holder is also influenced by temperature variation so that it expands slightly. However, this expansion is not sufficiently large to compensate for the shrinkage of the insulating bushing with the result that a gap is formed between the metal holder and the insulating bushing, thus loosening the external connection terminal.

Where an insulating bushing made of resin is used, and a terminal plate is secured to the external connecting terminal with a screw, it becomes impossible to firmly secure the terminal plate because of the rotation of the external connecting terminal. Rotation of the external connection terminal twists the conductor that interconnects the external terminal and the heater rod, resulting in breakage of the electrical connection. Furthermore, a gap formed between the insulating bushing and the holder permits water or oil to enter into a space in the holder in which the conductor is contained, which causes corrosion of the electric connection.

SUMMARY OF THE INVENTION

Accordingly, it is an object of this invention to provide an improved glow plug for use in a diesel engine and a method of manufacturing the plug in which the holder and the insulating bushing are firmly interconnected for increasing the mechanical strength as well as the airtightness.

According to one aspect of this invention there is provided a glow plug for use in a diesel engine comprising a heater rod, a hollow holder for holding the heater rod at one end of the holder, an insulating bushing held by the other end of the holder, an external connecting terminal supported by the insulating bushing and electrically connected to the heater rod, the insulating bushing being constituted by a metal pipe received in the other end of the hollow holder and an insulator integrally contained in the metal pipe, the external connecting terminal being embedded in the insulator, and the metal pipe being deformed by an external pressure applied to the other end of the hollow holder, thus air tightly pressing the insulator against the external connecting terminal.

According to another aspect of this invention there is provided a method of manufacturing a glow plug for use in a diesel engine, characterized by comprising the steps of forming a heater rod having an electric heater, forming a hollow holder, air tightly inserting the heater rod into one end of the hollow holder, preparing a terminal unit comprising a metal pipe, an electric insulator contained in the metal pipe and an external connecting terminal embedded in the electric insulator, inserting the terminal unit into the other end of the hollow holder, applying an external pressure to the other end of the hollow holder to deform the metal pipe for firmly bonding the same to the electric insulator, and electrically connecting the electric heater of the heating rod to the external connecting terminal.

It is advantageous to caulk an end surface of the other end of the hollow holder to form an annular ring which holds the terminal unit in its inserted position.

DESCRIPTION OF THE PREFERRED EMBODIMENT

Figure 1:
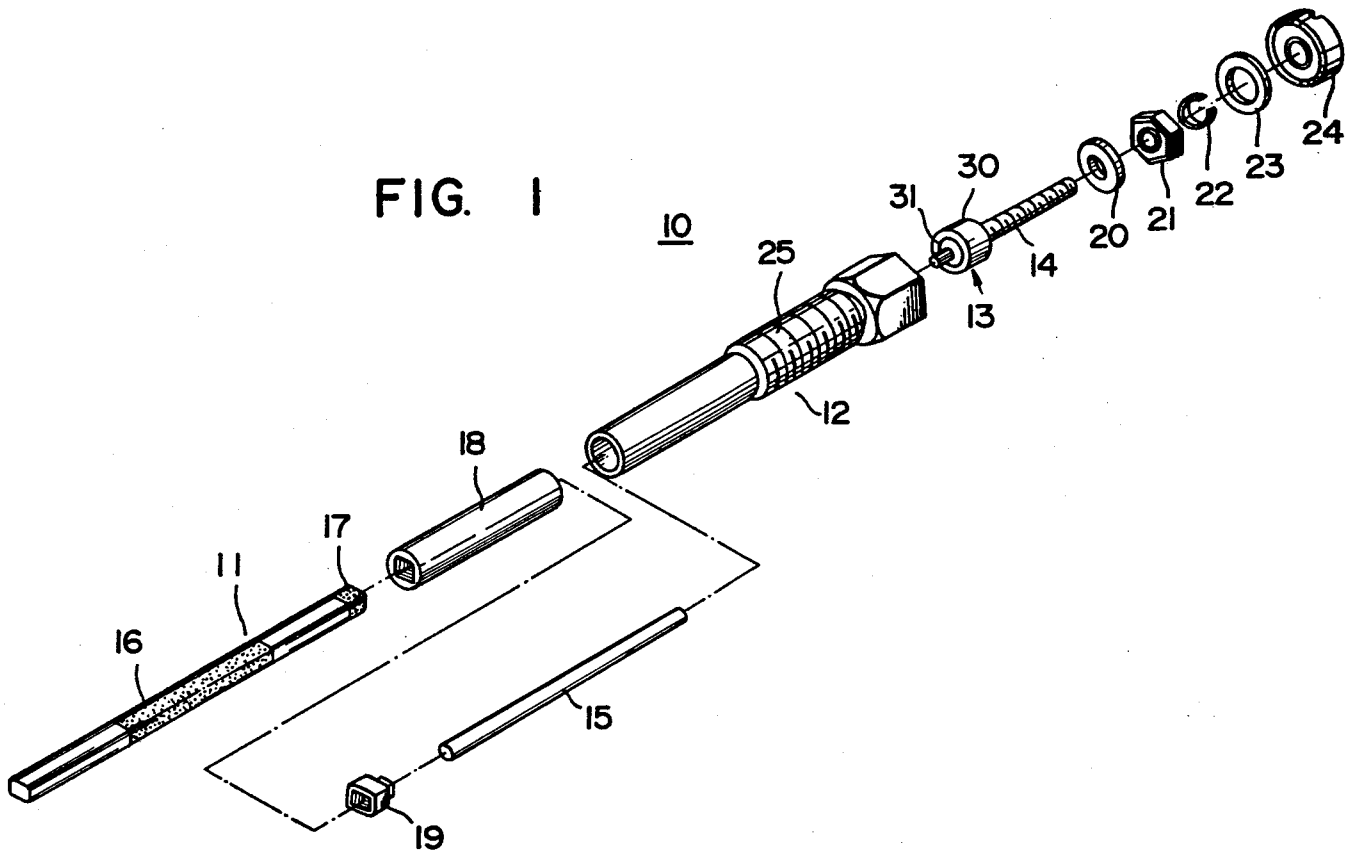
FIG. 1 is an exploded perspective view showing one embodiment of a glow plug according to this invention.
Figure 2:
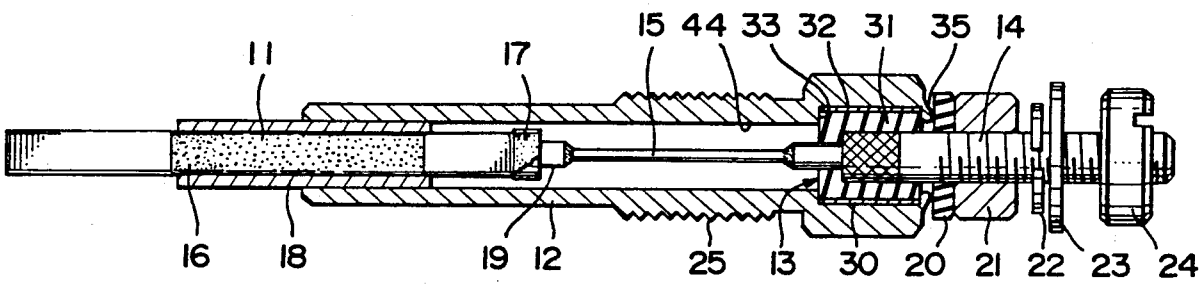
FIG. 2 is a longitudinal sectional view of an assembled glow plug.

As shown in FIGS. 1 and 2, a glow plug 10 embodying the invention comprises a heater rod 11 made of ceramic material and having an elliptical cross-sectional configuration, and a metallic tubular holder 12 which holds the heater rod 11 at one end thereof. An external connecting terminal 14 is inserted into the other end of the holder 12 via an insulating bushing 13, and the external connecting terminal 14 is connected to the rear end of the heater rod 11 via a conductor 15 made of iron or the like.

Metal coating layers 16 and 17 are applied to the central portion, and, the rear end and the end surface of the heater rod 11 and these metal coating layers 16, 17 are connected, through lead wires, to the opposite ends of a resistor (not shown) embedded in the heater rod 11. The central metal coating layer 16 is connected to the holder 12 through a reinforcing metal tube 18 fitted on to the layer 16. A terminal cap 19 is mounted on the rear end of the heater rod 11 which is connected to the conductor 15. The metal tube 18 is used as an auxiliary member for holding the heater rod 11 having elliptical cross-section at the fore end of the holder 12. The inner opening of the metal tube 18 is shaped to be commensurate with the cross-sectional configuration of the heater rod 11 and the metal tube 18 is secured to the heater rod 11 as by silver brazing. Also the terminal cap 19 is shaped to be commensurate with the crosssectional configuration of the heater rod 11 and secured to the heater rod as by silver brazing and the conductor 15 is connected to the terminal cap 19 as by soldering.

The external connecting terminal 14 is formed with screw threads for receiving an insulating ring 20, a nut 21, a spring washer 22, a washer 23 and a nut 24 for clamping an external lead wire. Thus, a lead wire from a battery or the like is inserted between the washer 23 and the nut 24 and then clamped by tightening the nut 24. The holder 12 is formed with screw threads for driving the holder into a threaded opening provided for a cylinder housing so as to connect the heating rod 11 to the ground and to cause the heating rod to project into the cylinder.

According to this invention, the insulating bushing 13 for connecting the external connecting terminal 14 to the rear end of the holder 12 is constituted by a metal pipe 30 and an insulator 311 formed integrally therewith for holding the external connecting terminal 14 at its center. The insulating bushing 13 can prevent loosening between the holder and the bushing caused by temperature variation which was inevitable in a prior art insulating bushing made of resin, thus not only ensuring firm bonding between the insulating bushing and the holder but also improving air tightness therebetween.

Figure 3:
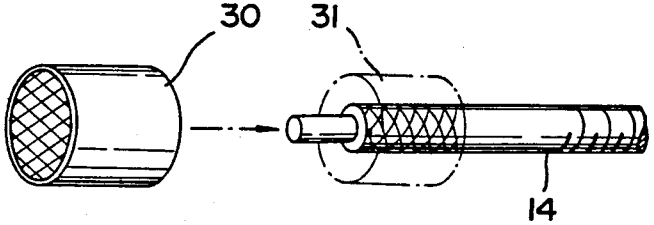
FIG. 3 is an enlarged exploded perspective view of a terminal unit.

More particularly, as shown in FIG. 3, the insulating bushing 13 is fabricated as an integral terminal unit by force fitting the metal pipe 30 about the insulator 31 made of a synthetic resin and secured to the inner end of the external connecting terminal 14. When knurlings are formed on the periphery of the inner end of the external connecting terminal 14 and on the inner surface of the metal pipe 30 the bonding strength therebetween can be improved, but this is immaterial to this invention. When forming the insulator 31, the external connecting terminal 14 may be disposed in a metal mold together with the metal pipe 30 so as to perform so-called insert molding. With any method, it is essential to integrally form the insulator 31 holding the external connecting terminal 14 in the metal pipe 30. The length of the metal pipe 30 is made to be equal to that of the insulator 31.

The rear end of the holder 12 is formed with an opening 32 for receiving the insulating bushing 13. A shoulder 33 is formed at the inner end of the opening 32 to receive the inner end of the insulating bushing 13. A through hole 34 communicating with the opening 32 is formed in the holder 12 for containing the conductor 15 extending between the heater rod 11 and the terminal 14.

The inner diameter of the opening 32 is much the same as the outer diameter of the metal pipe 30 but its precision is not critical. The distance between the lower shoulder 33 and the upper end edge of the opening 32 is slightly smaller than the axial length of the metal pipe 30.

Figure 4:
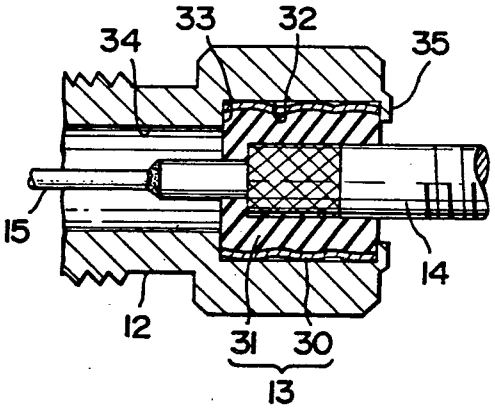
FIG. 4 is an enlarged sectional view of a portion of the assembled plug shown in FIG. 2.

After inserting the insulating bushing 13 into the opening 32, a high pressure is applied to the outer end of the holder 12 and the end thereof is caulked to form a holding ring 35. Accordingly, the insulating bushing is firmly held by the holder and the metal pipe 30 is deformed by the pressure as exaggeratedly shown in FIG. 4. Accordingly, the metal pipe 30 is firmly bonded to the insulator 31 and hence the insulator 31 is also firmly bonded to the external connecting pipe 14.

With this construction, even when the insulator 31 shrinks slightly due to the decrease in the ambient temperature, the metal pipe 30 absorbs such shrinkage, thus preventing loosening and preserving air tightness.

Where a metal pipe 30 having a wall thickness of 0.75 mm is used, the pressure applied from outside is about 1.5 to 2.0 tons.

It should be understood that the heater rod 11 can be made of any suitable material other than ceramic.

As above described this invention provides an improved glow plug capable of firmly connecting an external connecting terminal to a heater rod and maintaining a high air tightness regardless of the variation in the ambient temperature.

What is claimed is:

1. A glow plug for use in a diesel engine comprising:

a heater rod made of ceramic material and containing heating means electrically connected to a pair of metal coating portions formed on said heater rod;

a metallic holder for holding said heater rod at one end of the holder and electrically coupling an electrically conductive hollow holder with one of said metal coating portions, said hollow holder being provided with an enlarged opening having a shoulder inside at the other end of the hollow holder;

an insulating bushing held in said enlarged opening by the other end of said hollow holder;

an external connecting terminal supported by said insulating bushing; and an electric conductor connecting said external connecting terminal to the other metal coating portion on said heater rod;

said insulating bushing being constituted by a metal pipe received in said other end of said hollow holder and an insulator integrally contained in said metal pipe, said external connecting terminal being embedded in said insulator, and said metal pipe being deformed by an external pressure applied to said other end of said hollow holder thus airtightly pressing said insulator against said external connecting terminal.

2. The glow plug according to claim 1 wherein an inner surface of said metal pipe and an outer surface of said external connecting terminal embedded in said insulator are provided with knurlings.

3. The glow plug according to claim 1 wherein said heater rod has a substantially ellipital cross-sectional configuration.

4. A glow plug for use in a diesel engine comprising:

a heater rod made of dielectric material and containing heating means electrically connected to a pair of metal coating portions formed on said heater rod;

an electrically conductive hollow holder, electrically coupled to one of said metal coating portions, for holding said heater rod at one end of the holder, the other end of said electrically conductive hollow holder having an enlarged opening with a shoulder at the inner end of the opening;

an insulating bushing inserted into said enlarged opening until stopped by said shoulder;

an annular ring, for holding said insulating bushing in an inserted state, formed by caulking an end surface of said other end of said hollow holder; and an external connecting terminal supported by said insulating bushing and electrically connected to the other metal coating portion of said heater rod;

said insulating bushing being constituted by a metal pipe received in said other end of said hollow holder and an insulator integrally contained in said metal pipe:

said external connecting terminal being embedded in said insulator; and said metal pipe being deformed by an external pressure applied to said other end of said hollow holder thus air tightly pressing said insulator against said external connecting terminal.

* * * * *